US007976102B2

(12) United States Patent
Chang

(10) Patent No.: US 7,976,102 B2
(45) Date of Patent: Jul. 12, 2011

(54) SEAT HAVING A SADDLE SHAPE TO FIT A USER ERGONOMICALLY

(76) Inventor: Kuo-Chyang Chang, Kaohsiung (TW)

( * ) Notice: Subject to any disclaimer, the term of this patent is extended or adjusted under 35 U.S.C. 154(b) by 179 days.

(21) Appl. No.: 12/475,693

(22) Filed: Jun. 1, 2009

(65) Prior Publication Data

US 2010/0301646 A1 Dec. 2, 2010

(51) Int. Cl.
*B62J 1/00* (2006.01)
*B62J 1/08* (2006.01)

(52) U.S. Cl. ..... 297/201

(58) Field of Classification Search ..... 297/201
See application file for complete search history.

(56) References Cited

U.S. PATENT DOCUMENTS 608,682 A * 8/1898 Jamieson ..... 297/201
619,204 A * 2/1899 Moore ..... 297/201
629,956 A * 8/1899 Craig ..... 297/201
635,598 A * 10/1899 Rowe ..... 297/201
4,877,286 A * 10/1989 Hobson et al. ..... 297/201 X
5,123,698 A * 6/1992 Hodges ..... 297/201
5,352,016 A * 10/1994 Hobson ..... 297/201
6,290,291 B1 * 9/2001 Kojima ..... 297/201
7,249,800 B2 * 7/2007 Jalkanen ..... 297/201
7,494,181 B2 * 2/2009 Tucker ..... 297/201
2008/0054689 A1 * 3/2008 Tucker ..... 297/201

* cited by examiner

*Primary Examiner* — Rodney B White
(74) *Attorney, Agent, or Firm* — Alan Kamrath; Kamrath & Associates PA

(57) ABSTRACT

A seat includes a first seat body and a second seat body juxtaposed to and combined with the first seat body. The first seat body has a bottom provided with a first connecting plate. The second seat body has a bottom provided with a second connecting plate movably mounted on the first connecting plate of the first seat body. Thus, the distance and angle between the second seat body and the first seat body can be adjusted freely according to users of different sizes so that the seat is designed to satisfy the requirements of different users.

18 Claims, 6 Drawing Sheets

SEAT HAVING A SADDLE SHAPE TO FIT A USER ERGONOMICALLY

BACKGROUND OF THE INVENTION

1. Field of the Invention

The present invention relates to a seat and, more particularly, to a seat for a chair.

2. Description of the Related Art

A conventional chair 1 in accordance with the prior art shown in FIG. 8 comprises a seat support unit 12 and a seat 10 mounted on a top of the seat support unit 12. However, the seat 10 has a fixed size that cannot be adjusted freely according to users of different sizes so that the seat 10 cannot satisfy the requirements of different users.

BRIEF SUMMARY OF THE INVENTION

In accordance with the present invention, there is provided a seat, comprising a first seat body and a second seat body juxtaposed to and combined with the first seat body. The first seat body has a bottom provided with a first connecting plate. The second seat body has a bottom provided with a second connecting plate movably mounted on the first connecting plate of the first seat body.

The primary objective of the present invention is to provide a seat having a saddle shape to fit a user ergonomically.

Another objective of the present invention is to provide a seat whose size and angle can be adjusted freely.

A further objective of the present invention is to provide a seat, wherein the distance and angle between the second seat body and the first seat body can be adjusted freely according to users of different sizes so that the seat is designed to satisfy the requirements of different users.

A further objective of the present invention is to provide a seat, wherein the first seat body is provided with a plurality of elongate first reinforcing ribs, and the second seat body is provided with a plurality of elongate second reinforcing ribs so that the seat has a greater strength to withstand users of heavier weights.

A further objective of the present invention is to provide a seat, wherein the first seat body is provided with an elongate first groove, and the second seat body is provided with an elongate second groove, so that the first seat body and the second seat body will not be distorted or deformed due to compression during the molding process, thereby increasing the quality of the product.

A further objective of the present invention is to provide a seat, wherein the second seat body and the first seat body form a complete saddle so that the seat is designed ergonomically to provide a comfortable sensation to the users.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
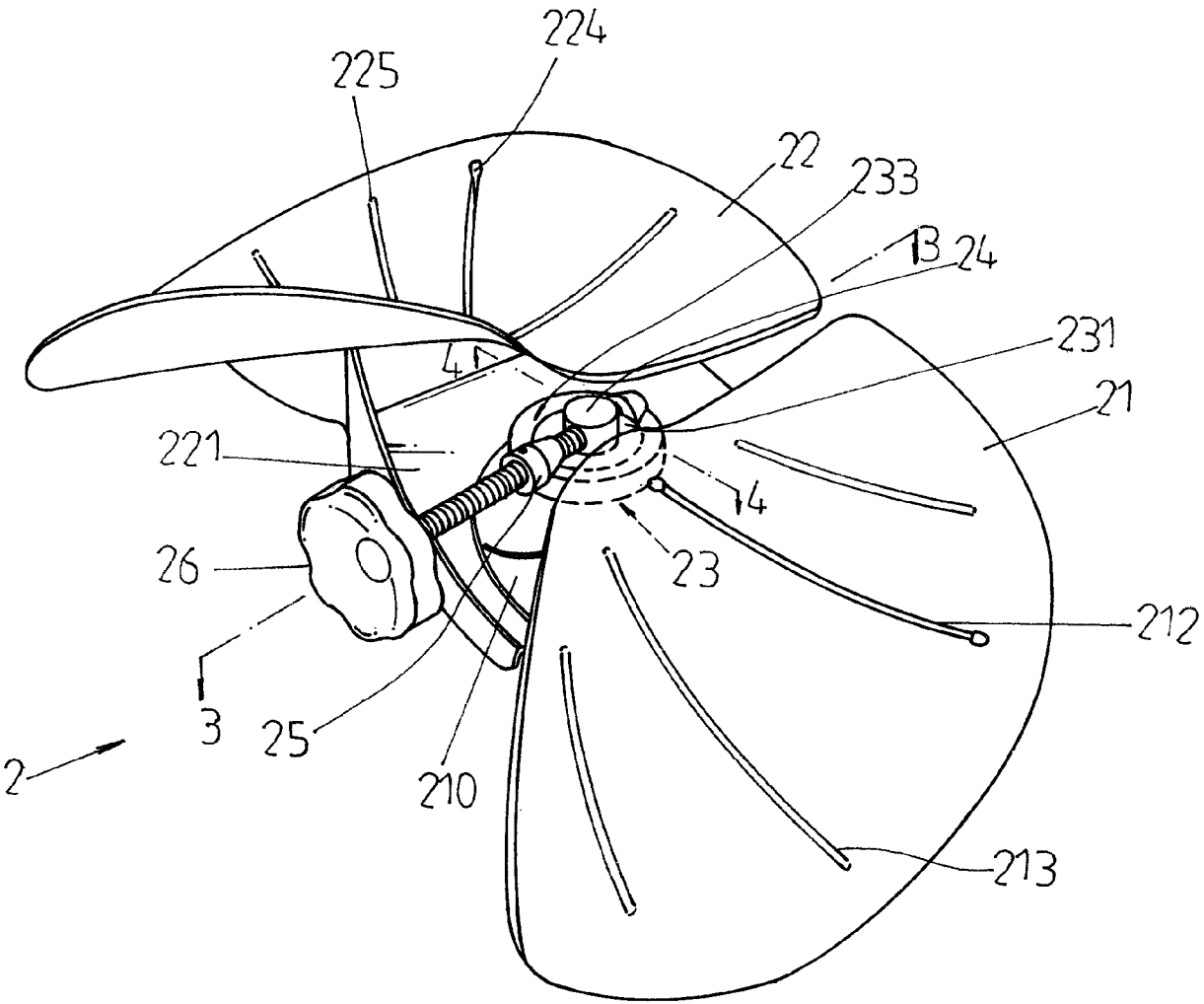
FIG. 1 is a perspective view of a seat in accordance with the preferred embodiment of the present invention.

Referring to the drawings and initially to FIGS. 1-4, a seat 2 in accordance with the preferred embodiment of the present invention comprises a first seat body 22 and a second seat body 21 juxtaposed to and combined with the first seat body 22. The first seat body 22 has a bottom provided with a first connecting plate 221. The second seat body 21 has a bottom provided with a second connecting plate 210 movably mounted on the first connecting plate 221 of the first seat body 22.

Figure 3:
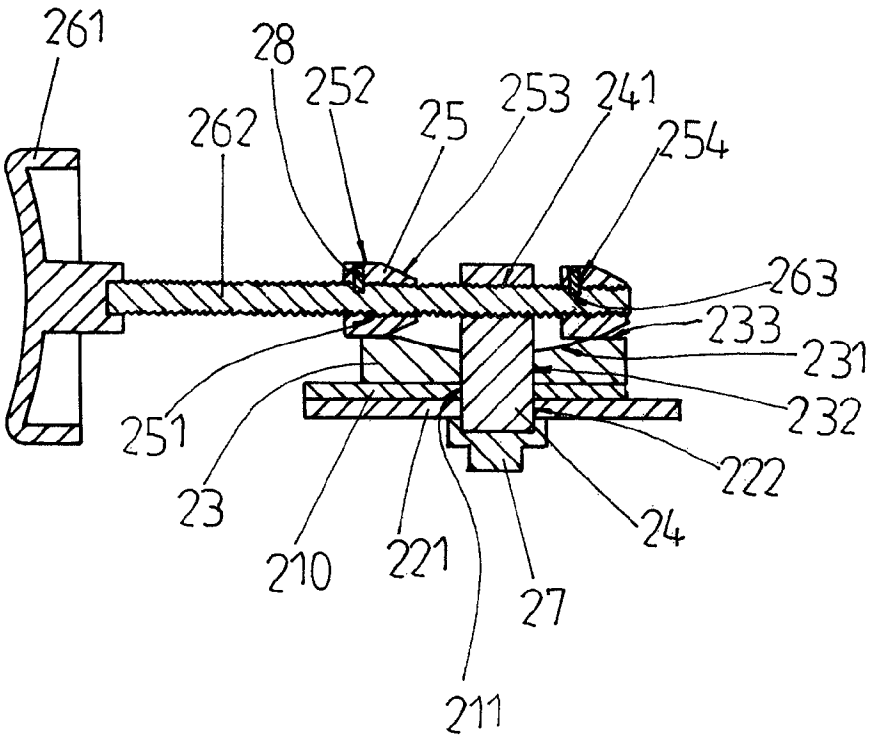
FIG. 3 is a cross-sectional view of the seat taken along line 3-3 as shown in FIG. 1.
Figure 5:
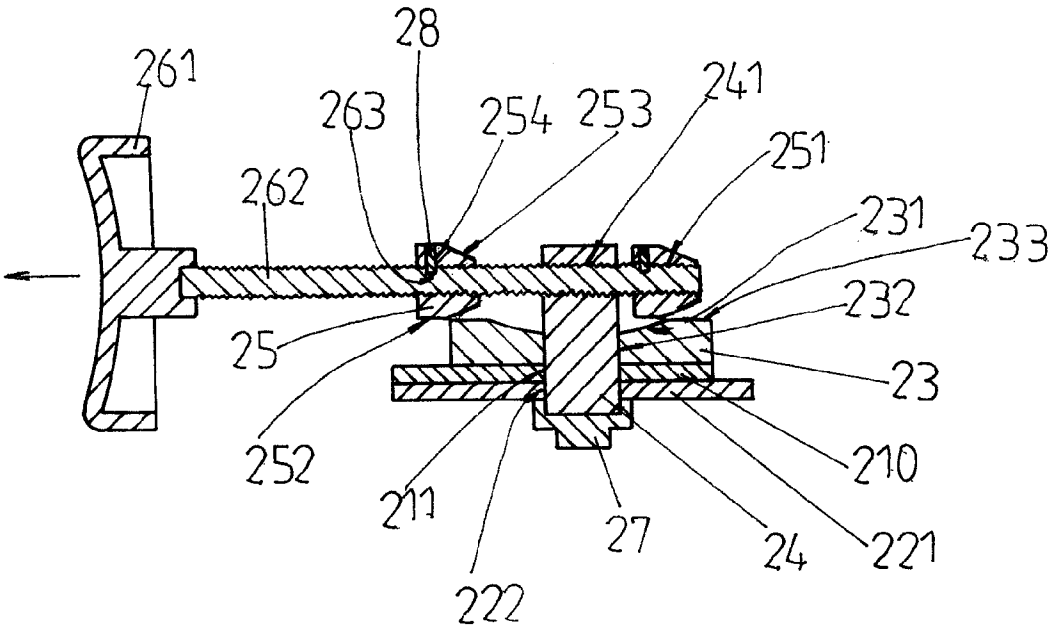
FIG. 5 is a schematic operational view of the seat as shown in FIG. 3.

The seat 2 further comprises a locking member 23 mounted on the second connecting plate 210 of the second seat body 21 and having a top provided with a driven plane 233, at least one pressing member 25 movably mounted on the locking member 23 and having a first end provided with a pressing plane 252 that is movable to abut the driven plane 233 of the locking member 23 as shown in FIG. 3 to press the locking member 23 toward the second connecting plate 210 of the second seat body 21 and the first connecting plate 221 of the first seat body 22 and a second end provided with a ramp 253 that is movable to abut the driven plane 233 of the locking member 23 as shown in FIG. 5 to release the locking member 23 from the second connecting plate 210 of the second seat body 21 and the first connecting plate 221 of the first seat body 22, a support rod 24 extending through the locking member 23, the second connecting plate 210 of the second seat body 21 and the first connecting plate 221 of the first seat body 22, a control bolt 26 movably mounted on the support rod 24 and connected with the pressing member 25 to move the pressing member 25 relative to the locking member 23, at least one fixing pin 28 extending into the pressing member 25 and the control bolt 26 to fix the pressing member 25 onto the control bolt 26, and a fastening member 27 connected with the support rod 24 and secured on the first connecting plate 221 of the first seat body 22.

The first seat body 22 has a substantially semi-saddle shape and has a top provided with an elongate first groove 224 and a plurality of elongate first reinforcing ribs 225. The first connecting plate 221 of the first seat body 22 has a substantially L-shaped profile and is located under and spaced from the first seat body 22. The first connecting plate 221 of the first seat body 22 is provided with a through hole 222 to allow passage of the support rod 24. The first connecting plate 221 of the first seat body 22 has a periphery provided with a plurality of fixing holes 223 to attach the first connecting plate 221 of the first seat body 22 to a seat support (not shown).

The second seat body 21 has a substantially semi-saddle shape and has a top provided with an elongate second groove 212 and a plurality of elongate second reinforcing ribs 213. The second seat body 21 and the first seat body 22 form a complete saddle. The second connecting plate 210 of the second seat body 21 has a substantially L-shaped profile and is located under and spaced from the second seat body 21. The second connecting plate 210 of the second seat body 21 is provided with an elongate guide slot 211 aligning with the through hole 222 of the first connecting plate 221 to allow passage of the support rod 24. The guide slot 211 of the second connecting plate 210 is movable on the support rod 24 when the second connecting plate 210 of the second seat body 21 is movable relative to the first connecting plate 221 of the first seat body 22.

The locking member 23 has a central portion provided with a through bore 232 aligning with the guide slot 211 of the second connecting plate 210 to allow passage of the support rod 24. The driven plane 233 of the locking member 23 has an annular shape and surrounds the through bore 232 of the locking member 23. The locking member 23 has a periphery provided with an arcuate recess 231 located between the driven plane 233 and the through bore 232 of the locking member 23.

The fastening member 27 is fixed on a bottom of the first connecting plate 221 of the first seat body 22 by soldering. The fastening member 27 has an inner portion provided with an inner thread 272.

The support rod 24 in turn extends through the through bore 232 of the locking member 23, the guide slot 211 of the second connecting plate 210 and the through hole 222 of the first connecting plate 22 1. The support rod 24 has an upper end protruding outwardly from the locking member 23 and provided with a screw bore 241. The support rod 24 has a lower end protruding outwardly from the first connecting plate 221 of the first seat body 22 and provided with an outer thread 242 screwed into the inner thread 272 of the fastening member 27.

The control bolt 26 includes a threaded rod 262 screwed into the screw bore 241 of the support rod 24 and an enlarged bolt head 261 mounted on an end portion of the threaded rod 262. The threaded rod 262 of the control bolt 26 has a periphery provided with at least one fixing bore 263. The threaded rod 262 of the control bolt 26 is movable axially relative to the support rod 24 by rotation of the threaded rod 262 relative to the support rod 24.

The pressing member 25 has an inner portion provided with a passage 251 to allow passage of the threaded rod 262 of the control bolt 26. The pressing member 25 has a periphery provided with an aperture 254 aligning with the fixing bore 263 of the threaded rod 262. The aperture 254 of the pressing member 25 is located at the pressing plane 252 and is connected to the passage 251.

The fixing pin 28 extends through the aperture 254 of the pressing member 25 and has a lower end fixed in the fixing bore 263 of the threaded rod 262 to lock the pressing member 25 onto the threaded rod 262 of the control bolt 26, so that the pressing member 25 is movable in concert with the threaded rod 262 of the control bolt 26.

In the preferred embodiment of the present invention, the seat 2 comprises two pressing members 25 and two fixing pins 28, and the threaded rod 262 of the control bolt 26 is provided with two fixing bores 263. Thus, the locking member 23 is located between the two pressing members 25.

Figure 2:
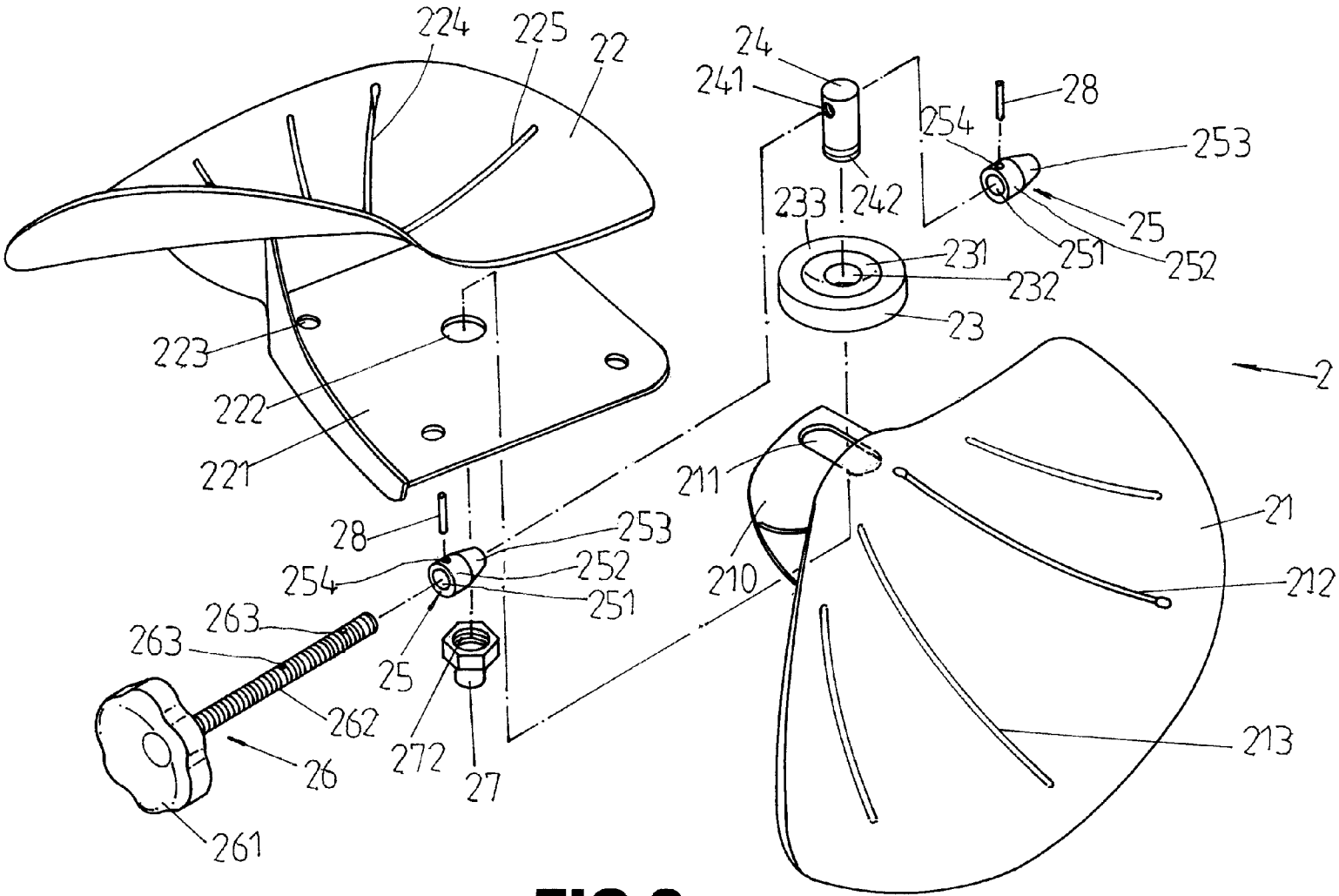
FIG. 2 is an exploded perspective view of the seat as shown in FIG. 1.

In operation, referring to FIGS. 3-6 with reference to FIGS. 1 and 2, the pressing plane 252 of the pressing member 25 initially abuts the driven plane 233 of the locking member 23 as shown in FIG. 3 to press the locking member 23 toward the second connecting plate 210 of the second seat body 21 and the first connecting plate 221 of the first seat body 22, so that the second connecting plate 210 of the second seat body 21 is locked onto the first connecting plate 221 of the first seat body 22 by the locking member 23.

On the contrary, when the control bolt 26 is rotated by a user, the threaded rod 262 of the control bolt 26 is moved axially relative to the support rod 24 by rotation of the threaded rod 262 relative to the support rod 24, and the pressing member 25 is moved relative to the locking member 23, so that the ramp 253 of the pressing member 25 is moved to abut the driven plane 233 of the locking member 23 as shown in FIG. 5 to release the locking member 23 from the second connecting plate 210 of the second seat body 21 and the first connecting plate 221 of the first seat body 22.

Figure 4:
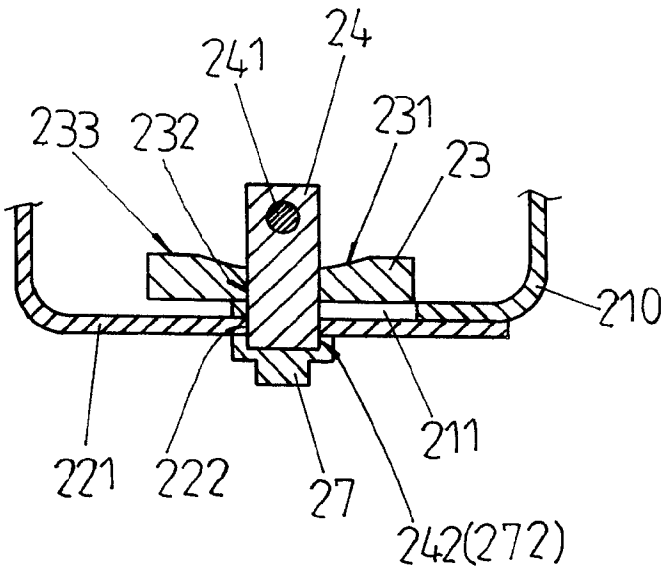
FIG. 4 is a cross-sectional view of the seat taken along line 4-4 as shown in FIG. 1.
Figure 6:
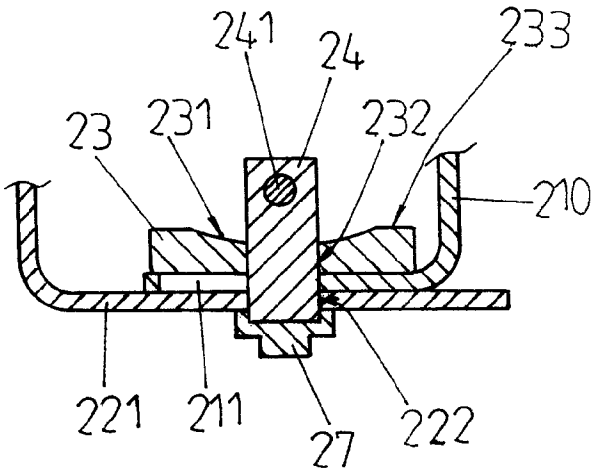
FIG. 6 is a schematic operational view of the seat as shown in FIG. 4.

In such a manner, the second connecting plate 210 of the second seat body 21 is unlocked from the first connecting plate 221 of the first seat body 22 by releasing the locking member 23. Thus, the second connecting plate 210 of the second seat body 21 is moved relative to the first connecting plate 221 of the first seat body 22 as shown in FIGS. 4 and 6 so as to adjust the distance and angle between the second seat body 21 and the first seat body 22. At this time, the guide slot 211 of the second connecting plate 210 is moved on the support rod 24 when the second connecting plate 210 of the second seat body 21 is moved relative to the first connecting plate 221 of the first seat body 22 so that the support rod 24 can guide movement of the second seat body 21 relative to the first seat body 22.

Accordingly, the distance and angle between the second seat body 21 and the first seat body 22 can be adjusted freely according to users of different sizes so that the seat 2 is designed to satisfy the requirements of different users. In addition, the first seat body 22 is provided with a plurality of elongate first reinforcing ribs 225, and the second seat body 21 is provided with a plurality of elongate second reinforcing ribs 213 so that the seat 2 has a greater strength to withstand users of heavier weights. Further, the first seat body 22 is provided with an elongate first groove 224, and the second seat body 21 is provided with an elongate second groove 212, so that the first seat body 22 and the second seat body 21 will not be distorted or deformed due to compression during the molding process, thereby increasing the quality of the product. Further, the second seat body 21 and the first seat body 22 form a complete saddle so that the seat 2 is designed ergonomically to provide a comfortable sensation to the users.

Figure 7:
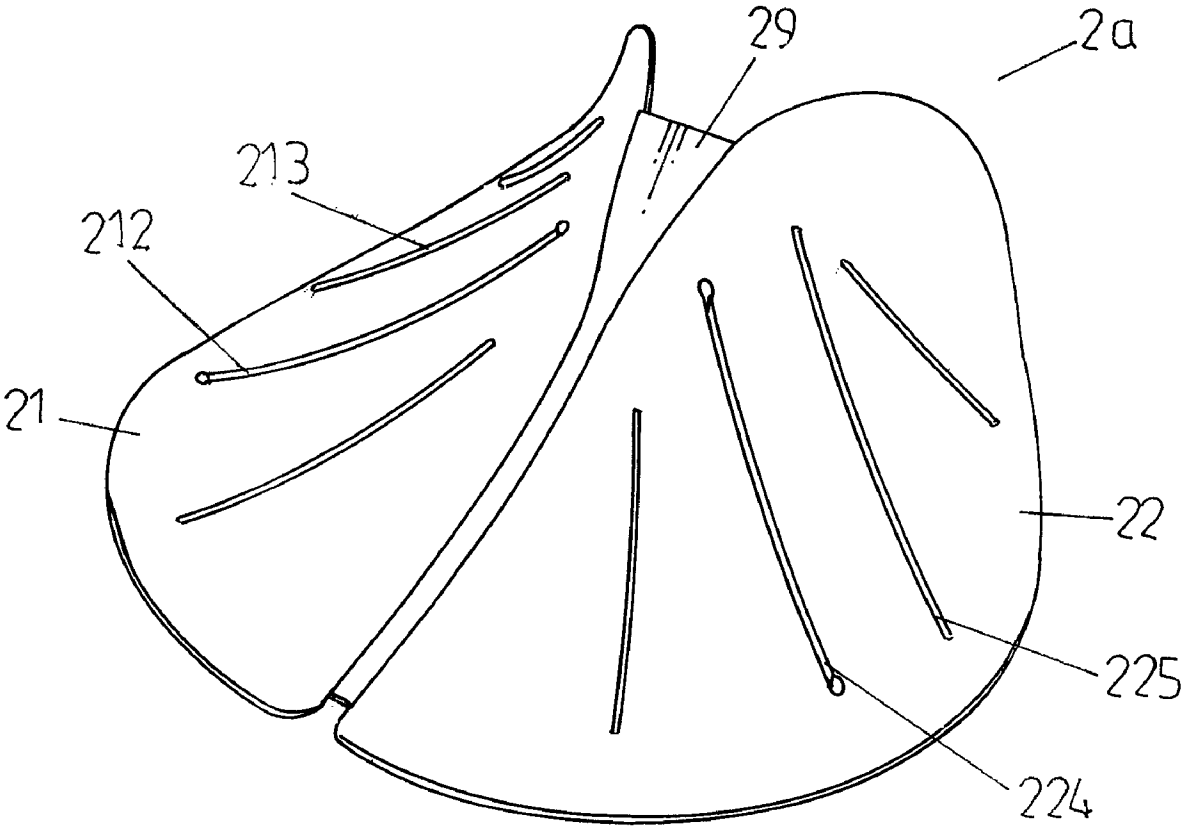
FIG. 7 is a perspective view of a seat in accordance with another preferred embodiment of the present invention.
Figure 8:
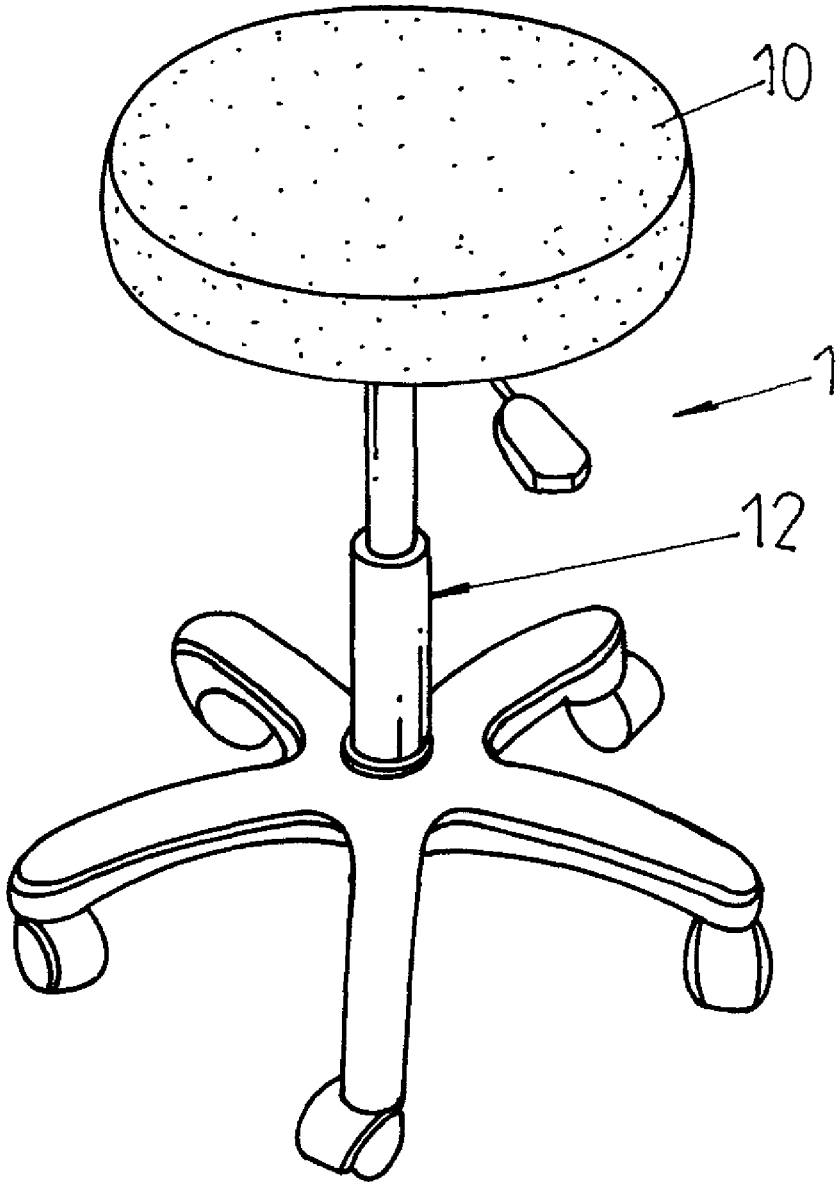
FIG.8 PRIOR ART
FIG. 8 is a perspective view of a conventional chair in accordance with the prior art.

As shown in FIG. 7, the second seat body 21 and the first seat body 22 are connected by a connecting piece 29 so that the second seat body 21 and the first seat body 22 are combined integrally to form a seat 2a which has a fixed size.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A seat, comprising:

a first seat body;

a second seat body juxtaposed to and combined with the first seat body;

wherein the first seat body has a bottom provided with a first connecting plate;

the second seat body has a bottom provided with a second connecting plate movably mounted on the first connecting plate of the first seat body;

the seat further comprises:

a locking member mounted on the second connecting plate of the second seat body and having a top provided with a driven plane;

at least one pressing member movably mounted on the locking member and having a first end provided with a pressing plane that is movable to abut the driven plane of the locking member to press the locking member toward the second connecting plate of the second seat body and the first connecting plate of the first seat body, and a second end provided with a ramp that is movable to abut the driven plane of the locking member to release the locking member from the second connecting plate of the second seat body and the first connecting plate of the first seat body;

a support rod extending through the locking member, the second connecting plate of the second seat body and the first connecting plate of the first seat body;

a control bolt movably mounted on the support rod and connected with the pressing member to move the pressing member relative to the locking member.

2. A seat, comprising:

a first seat body;

a second seat body juxtaposed to and combined with the first seat body; wherein the first seat body has a top provided with an elongate first groove;

the second seat body has a top provided with an elongate second groove.

3. A seat, comprising:

a first seat body;

a second seat body juxtaposed to and combined with the first seat body; wherein the first seat body has a top provided with a plurality of elongate first reinforcing ribs;

the second seat body has a top provided with a plurality of elongate second reinforcing ribs.

4. The seat of claim 1, wherein the first connecting plate of the first seat body is provided with a through hole to allow passage of the support rod;

the second connecting plate of the second seat body is provided with an elongate guide slot aligning with the through hole of the first connecting plate to allow passage of the support rod;

the guide slot of the second connecting plate is movable on the support rod when the second connecting plate of the second seat body is movable relative to the first connecting plate of the first seat body;

the locking member has a central portion provided with a through bore aligning with the guide slot of the second connecting plate to allow passage of the support rod.

5. The seat of claim 4, wherein the support rod in turn extends through the through bore of the locking member, the guide slot of the second connecting plate and the through hole of the first connecting plate.

6. The seat of claim 4, wherein the locking member has a periphery provided with an arcuate recess located between the driven plane and the through bore of the locking member.

7. The seat of claim 1, wherein the support rod has an upper end protruding outwardly from the locking member and provided with a screw bore;

the control bolt includes a threaded rod screwed into the screw bore of the support rod and an enlarged bolt head mounted on an end portion of the threaded rod.

8. The seat of claim 7, further comprising:

at least one fixing pin extending into the pressing member and the control bolt to fix the pressing member onto the control bolt.

9. The seat of claim 8, wherein the seat comprises two pressing members and two fixing pins;

the threaded rod of the control bolt is provided with two fixing bores;

the locking member is located between the two pressing members.

10. The seat of claim 8, wherein the threaded rod of the control bolt has a periphery provided with at least one fixing bore;

the pressing member has an inner portion provided with a passage to allow passage of the threaded rod of the control bolt;

the pressing member has a periphery provided with an aperture aligning with the fixing bore of the threaded rod;

the fixing pin extends through the aperture of the pressing member and has a lower end fixed in the fixing bore of the threaded rod to lock the pressing member onto the threaded rod of the control bolt, so that the pressing member is movable in concert with the threaded rod of the control bolt.

11. The seat of claim 10, wherein the threaded rod of the control bolt is movable axially relative to the support rod by rotation of the threaded rod relative to the support rod;

the aperture of the pressing member is located at the pressing plane and is connected to the passage.

12. The seat of claim 1, further comprising:

a fastening member connected with the support rod and secured on the first connecting plate of the first seat body.

13. The seat of claim 12, wherein the fastening member has an inner portion provided with an inner thread;

the support rod has a lower end protruding outwardly from the first connecting plate of the first seat body and provided with an outer thread screwed into the inner thread of the fastening member.

14. The seat of claim 13, wherein the fastening member is fixed on a bottom of the first connecting plate of the first seat body by soldering.

15. The seat of claim 1, wherein the second seat body and the first seat body are connected by a connecting piece;

the second seat body and the first seat body are combined integrally.

16. The seat of claim 1, wherein the firs connecting plate of the first seat body has a periphery provided with a plurality of fixing holes.

17. The seat of claim 1, wherein the first seat body has a substantially semi-saddle shape;

the second seat body has a substantially semi-saddle shape;

the second seat body and the first seat body form a complete saddle.

18. The seat of claim 1, wherein the first connecting plate of the first seat body has a substantially L-shaped profile and is located under and spaced from the first seat body;

the second connecting plate of the second seat body has a substantially L-shaped profile and is located under and spaced from the second seat body.

* * * * *